US009559420B2

(12) United States Patent
Ngo Bui Hung

(10) Patent No.: US 9,559,420 B2
(45) Date of Patent: Jan. 31, 2017

(54) ANTENNA SYSTEM WITH INTERLOCKING LOOPS AND VEHICLE COMPRISING SUCH AN ANTENNA SYSTEM

(71) Applicant: THALES, Neuilly sur Seine (FR)

(72) Inventor: Frederic Ngo Bui Hung, Gennevilliers (FR)

(73) Assignee: THALES, Neuilly sur Seine (FR)

( * ) Notice: Subject to any disclaimer, the term of this patent is extended or adjusted under 35 U.S.C. 154(b) by 168 days.

(21) Appl. No.: 14/088,183

(22) Filed: Nov. 22, 2013

(65) Prior Publication Data

US 2014/0145905 A1 May 29, 2014

(30) Foreign Application Priority Data

Nov. 23, 2012 (FR) ..... 12 03159

(51) Int. Cl.

| | |
|---|---|
| ***H01Q 21/00*** | (2006.01) |
| ***H01Q 7/00*** | (2006.01) |
| ***H01Q 1/32*** | (2006.01) |
| ***H01Q 21/28*** | (2006.01) |

(52) U.S. Cl.
CPC ..... *H01Q 7/00* (2013.01); *H01Q 1/3275* (2013.01); *H01Q 21/28* (2013.01)

(58) Field of Classification Search
CPC ..... H01Q 7/00
USPC ..... 343/867
See application file for complete search history.

(56) References Cited

U.S. PATENT DOCUMENTS

| | | | | |
|---|---|---|---|---|
| 2,368,174 | A * | 1/1945 | Thomas | H01Q 1/085 174/138 A |
| 3,588,905 | A | 6/1971 | Dunlavy, Jr. | |
| 4,217,591 | A | 8/1980 | Czerwinski | |
| 2002/0190909 | A1 | 12/2002 | Yamamoto et al. | |
| 2006/0017621 | A1* | 1/2006 | Okawara | H01Q 1/243 343/700 MS |
| 2012/0056790 | A1* | 3/2012 | Lee et al. | 343/702 |

FOREIGN PATENT DOCUMENTS

| | | |
|---|---|---|
| EP | 0897200 | 2/1999 |
| EP | 1246299 | 10/2002 |

OTHER PUBLICATIONS

Search Report issued in French App. No. 1203159 (2013).

* cited by examiner

*Primary Examiner* — Graham Smith
(74) *Attorney, Agent, or Firm* — Knobbe, Martens, Olson & Bear, LLP

(57) ABSTRACT

The invention relates to a loop antenna system comprising a first electrically conductive filiform element forming a loop portion. The antenna system further comprises a second electrically conductive filiform element forming a loop portion, and the two filiform elements have different lengths ($l_a$, $l_b$). The invention also relates to a vehicle including such an antenna system.

17 Claims, 3 Drawing Sheets

ANTENNA SYSTEM WITH INTERLOCKING LOOPS AND VEHICLE COMPRISING SUCH AN ANTENNA SYSTEM

CROSS REFERENCE TO RELATED APPLICATIONS

This application claims priority to French Application No. 1203159, filed Nov. 23, 2012, the content of which is herein incorporated by reference in its entirety.

The present invention relates to loop antenna systems.

More specifically, the invention relates to a loop antenna system comprising a first electrically conductive filiform element forming a loop portion.

The systems are in particular used in the field of HF telecommunications, for example on land or at sea, and rely on the use of near vertical sky waves to propagate electromagnetic waves that they transmit and receive.

In a known manner, the filiform conductive element of the systems generates a radiating surface. The radiation resistance $R_r$ of that surface is related to its area S and the working wavelength $\lambda$ using the following relationship:

$$R_r=320\pi^4(S^2/\lambda^4) \quad (1)$$

At low frequencies in the operating range of these antenna systems, i.e., at long working wavelengths $\lambda$, the instantaneous bandwidth of the systems is low due to the smallness of the radiation resistance $R_r$.

In light of relationship (1), one known solution for increasing the radiation resistance $R_r$ of these antenna systems is to increase the physical length of the filiform element, which results in increasing the area S of the radiation surface.

However, this solution is not fully satisfactory.

In fact, the increase in the dimensions of the filiform element tends to place the anti-resonance frequency of the antenna system, i.e., the frequency where the input impedance of the antenna becomes very large and difficult to adapt, in the useful frequency range of the system, which prevents the antenna system from being used at frequencies close to the anti-resonance frequency and therefore over the entire useful frequency range. Thus, a high energy output for this type of system requires limiting the useful bandwidth.

One of the aims of the invention is to propose an antenna system not having these drawbacks.

To that end, the invention relates to an antenna system of the aforementioned type, characterized in that the antenna system further comprises a second electrically conductive filiform element forming a loop portion, and in that the two filiform elements have different lengths with respect to one another.

According to other aspects of the invention, the antenna system comprises one or more of the following technical features, considered alone or according to any technically possible combination(s):

- the length of the longest filiform element is more than 50% longer than the length of the shortest filiform element;
- the length of the longest filiform element is substantially equal to twice the length of the shortest filiform element;
- the first filiform element is substantially comprised in a first plane, the second filiform element is substantially comprised in a second plane, and the first and second planes together form an angle smaller than 45°, and preferably smaller than 10°;

- the loop portions formed by the filiform elements are interlocked in one another;
- the antenna system comprises a fastening base for fastening filiform elements, the fastening base including a second electrically conductive part in which one end of each filiform element is fastened;
- the antenna system also includes an antenna tuning unit electrically connected to the second part to supply the two filiform elements with a same radiofrequency signal;
- the antenna system includes a secondary fastening base in which the other ends of the filiform elements are fastened, the antenna tuning unit having two symmetrical channels whereof one is connected to the fastening base, and the other is connected to the secondary fastening base;
- the antenna system includes a ground plane, said fastening base including a first electrically insulating part fastened on said first plane and on which the second part is fastened, the other ends of the filiform elements being fastened to the ground plane;
- the antenna system is intended for the transmission and reception of electromagnetic waves with a frequency comprised between 2 MHz and 30 MHz.

Furthermore, the invention relates to a land, air or sea vehicle, characterized in that it includes at least one antenna system according to the invention.

According to another aspect of the invention, the vehicle includes two antenna systems according to the invention, the antenna systems being identical to each other and being positioned side by side and parallel to each other.

BRIEF DESCRIPTION OF THE DRAWINGS

The invention will be better understood upon reading the following detailed description, provided solely as an example and done in reference to the appended Figures, in which:

FIG. 1 illustrates a vehicle 2 according to the invention. The vehicle 2 is intended for a land application, and is for example an all-terrain vehicle. The vehicle 2 includes a loop antenna system 4 according to the invention, hereafter system 4, as well as a metal surface 6.

Figure 1:
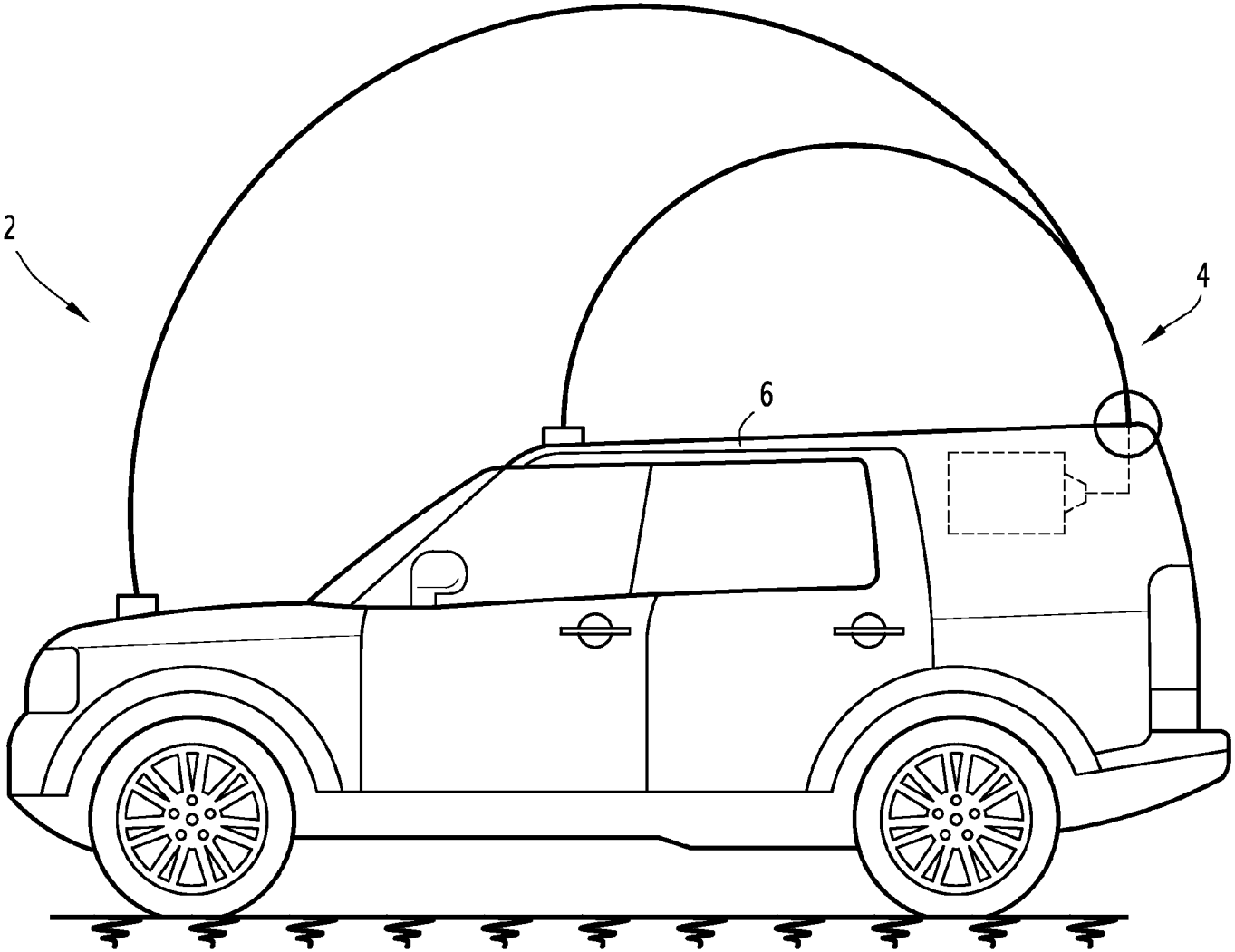
FIG. 1 is a diagrammatic illustration of a vehicle according to the invention.

In the example of FIG. 1, the metal surface 6 includes the roof and hood of the vehicle.

The system 4 is intended to operate in the frequency range of 2 MHz-30 MHz, and preferably in the frequency range of 2 MHz-12 MHz.

Figure 2:
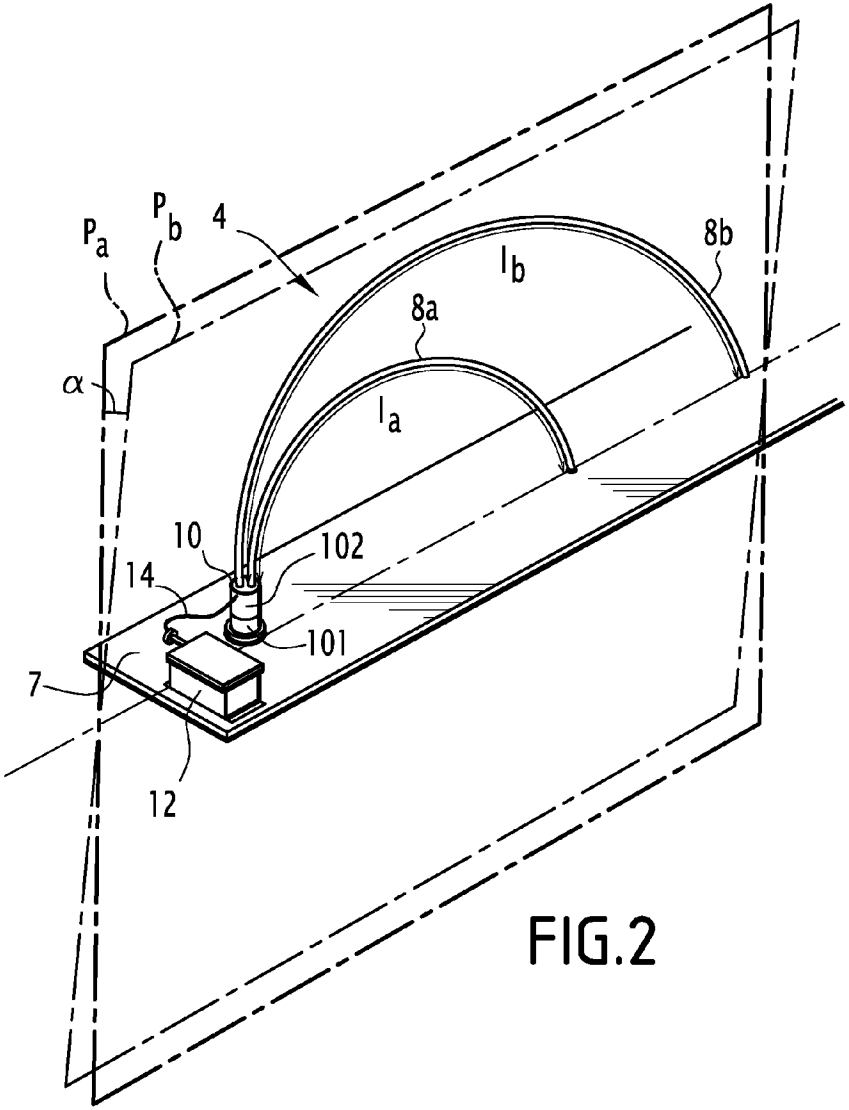
FIG. 2 is a diagrammatic illustration of an antenna system according to the invention.

In reference to FIG. 2, the system 4 includes a ground plane 7, two filiform elements with references 8*a*, 8*b*, respectively, as well as a fastening base 10, hereafter base 10. Furthermore, the system 4 includes an antenna tuning unit 12, designated ATU 12 hereinafter, and a connecting cable 14 connecting the ATU 12 to the base 10.

The ground plane 7 of the system 4 is capable of providing a ground reference to the system 4 and is formed by the metal surface 6 of the vehicle 2.

The filiform elements 8*a*, 8*b* are electrically conductive and are capable of transmitting and receiving electronic waves. They are for example made from copperweld.

Alternatively, they include a fiberglass core surrounded by a copper braid, or are made from any suitable material known by those skilled in the art.

"Filiform" means that the dimensions of the elements 8*a*, 8*b* lengthwise are of an order of magnitude much higher than the order of magnitude of the dimensions of the elements 8*a*, 8*b* in the other directions, and that the dimensions of the elements 8*a*, 8*b* in the directions other than its length are substantially of the same order of magnitude.

Furthermore, the filiform elements 8*a*, 8*b* are elastically deformable.

The filiform elements 8*a*, 8*b* are made up of a single segment.

Alternatively, at least one of the filiform elements 8*a*, 8*b* is made from multiple segments connected to each other. They are then mounted or disassembled to respectively mount or disassemble the corresponding filiform element 8*a*, 8*b*. This results in making it possible to minimize the bulk of the system 4 on the vehicle 2 when the system 4 is not needed.

The filiform elements 8*a*, 8*b* have respective lengths $l_a$, $l_b$ with an order of magnitude smaller than the wavelengths of the preferred working frequencies of the system 4.

More specifically, the filiform elements 8*a*, 8*b* have lengths $l_a$, $l_b$ of between 3 m and 6 m.

Alternatively, the filiform elements 8*a*, 8*b* have lengths $l_a$, $l_b$ of between 3 m and 10 m. This alternative is advantageously implemented when the vehicle 2 is of a suitable size for doing so.

Furthermore, the lengths $l_a$, $l_b$ of the filiform elements 8*a*, 8*b* are different from one to another. In the example of FIG. 2, the filiform element 8*a* is the shorter of the two.

More specifically, the length $l_a$, $l_b$ of the longest filiform element 8*a*, 8*b* is more than 50% longer than the length $l_a$, $l_b$ of the shortest filiform element 8*a*, 8*b*.

This increases the wireless performance of the system 4, as will be seen hereinafter.

Preferably, the length $l_a$, $l_b$ of the longest filiform 8*a*, 8*b* is substantially equal to twice the length $l_a$, $l_b$ of the shortest filiform element 8*a*, 8*b*. This is an optimal compromise between the bulk of the system 4 and its performance.

As illustrated in FIG. 2, the filiform elements 8*a*, 8*b* are fastened on the ground plane 7.

More specifically for the connection of the filiform elements 8*a*, 8*b* to the ATU 12, one of the ends of each element 8*a*, 8*b* is inserted into the base 10 in an orifice (not shown) comprised by the base 10.

The other end of each element 8*a*, 8*b* is fastened on the ground plane 7 by a grounding part well known by those skilled in the art.

The filiform elements 8*a*, 8*b* each form a loop portion.

In practice, the dimensions of the loop portions are obtained through suitable positioning of the fastening location of the end of the filiform elements 8*a*, 8*b* on the ground plane 7 via the grounding part.

The two filiform elements 8*a*, 8*b*, and therefore the loop portions that they delimit, are substantially included in a plane $P_a$, $P_b$, respectively.

The two planes $P_a$, $P_b$ together form an angle $\alpha$.

The value of the angle $\alpha$ contributes to determining the level of wireless coupling between the radiating surfaces formed by the filiform elements 8*a*, 8*b*.

Advantageously, the angle $\alpha$ between the planes $P_a$, $P_b$ is smaller than 45°, and preferably smaller than 10°.

This results in increasing the wireless coupling between the radiating surfaces and optimizing the lateral bulk of the antenna system.

Preferably, the angle $\alpha$ is substantially zero, which maximizes the wireless coupling between the radiating surfaces and minimizes the lateral bulk of the antenna system.

In practice, the value of the angle $\alpha$ may vary under the effect of the acceleration and deceleration of the vehicle 2.

Preferably, the filiform elements 8*a*, 8*b* are rigid enough for the angle $\alpha$ to remain smaller than 45°, and preferably smaller than 10° during movement of the vehicle 2. In practice, the necessary stiffness is obtained by varying the diameter of the filiform elements 8*a*, 8*b*.

As indicated above, the filiform elements 8*a*, 8*b* each generate a radiating surface S1, S2, respectively, delimited by the corresponding filiform element on the one hand, and by the ground plane 7 on the other hand. The radiating surfaces S1, S2 are substantially comprised in the corresponding plane $P_a$, $P_b$.

Preferably, the two radiating surfaces S1, S2 have the same general shape.

In the example of FIG. 2, the surfaces S1, S2 formed by the elements 8*a*, 8*b* are both substantially semicircular.

Alternatively, the loop portions formed by the filiform elements 8*a*, 8*b* both form rectangle or triangle portions.

Also alternatively, the surfaces S1, S2 have a different general shape from one another.

Because the two elements 8*a*, 8*b* have different lengths, the two surfaces S1, S2 have different areas.

Hereinafter, S1 will designate the radiating surface with a smaller area, i.e., the surface delimited by the small filiform element 8*a*.

The loop portions formed by the two filiform elements 8*a*, 8*b* are interlocked in one another.

"Interlocked" means that the smallest of the loop portions appears to be fully included in the area delimited by the larger loop portion when the system 4 is observed from a direction substantially perpendicular to one of the two surfaces S1, S2.

In other words, in reference to FIG. 2, the surface S1 appears to be fully contained in the surface S2 when the system 4 is viewed from the side.

This interlocking results in minimizing the bulk of the system 4.

The base 10 allows fastening of the filiform elements 8*a*, 8*b* on the ground plane 7 while providing electrical insulation for the filiform elements from the ground plane, and allows the electrical connection of the filiform elements to the connecting cable 14 and the ATU 12.

To that end, the base 10 includes a first electrically insulating part 101 and a second electrically conductive part 102. The two parts 101 and 102 are cylindrical and have the same diameter.

The first part 101 is fastened on the ground plane 7 and is made from an electrically insulating dielectric material.

The second part 102 is fastened on the first part 101 and is made from metal. Owing to the first part 101, it is electrically insulated from the ground plane 7.

The second part 102 is provided with orifices (not shown) in which one of the ends of each of the filiform elements 8*a*, 8*b* is fastened, as previously indicated.

Furthermore, the second part 102 receives one end of the connecting cable 14.

Because the second part 102 is electrically conductive, the connecting cable 14 is electrically connected to the ends of the two filiform elements 8*a*, 8*b* inserted into the base 10.

The ATU 12 is capable of adapting the impedance of the system 4, i.e., maximizing the electrical power exchanged between the system 4, respectively, and a RF transceiver device (not shown) to which the system 4 is coupled.

The ATU 12 is located on the ground plane 7.

Alternatively, it is located onboard the vehicle 2, for example in a cavity located below the ground plane 7.

As previously indicated, the ATU 12 is electrically connected to the base 10 via the connecting cable 14, and provides the same RF signal to both filiform elements 8*a*, 8*b*.

The operation of the system 4 according to the invention will now be described in reference to FIGS. 1 and 2.

During the operation of the system 4, the ATU 12 delivers a same RF signal to the filiform elements 8*a*, 8*b* through the base 10. The current travels through the filiform elements 8*a*, 8*b* and loops back on the ground plane 7.

Due to the fact that the antenna system 4 includes two filiform elements 8*a*, 8*b* with different lengths, the anti-resonance frequency of the system 4 is modified relative to a system having a single filiform element, and more specifically is different from the anti-resonance frequency that the system would have if it only had one of the filiform elements 8*a*, 8*b*.

As a result, when the working frequency is substantially equal to the anti-resonance frequency of the system 4, that working frequency is remote from the anti-resonance frequencies of the filiform elements 8*a*, 8*b*. This makes it possible to benefit from an impedance of the system 4 at its anti-resonance frequency that is lower than for a system with a single filiform element.

In other words, the coupling of the filiform elements 8*a*, 8*b* in the system 4 according to the invention lowers the impedance of the system to its anti-resonance frequency, and allows it to be adapted by an ATU, and therefore improves its overall energy output.

Furthermore, the instantaneous bandwidth of the system according to the invention, which results from the radiation resistance, is substantially increased due to the fact that it includes two radiation surfaces S1, S2, and therefore a total radiation surface larger than that of a system only including one of the filiform elements 8*a*, 8*b*.

For an antenna system of the state of the art including a single filiform element bent so as to form a semicircle with a diameter of 2 m, it has been modeled that the impedance of the system at 3 MHz is equal to 0.002+66 j Ω. The anti-resonance frequency of the system is equal to 23.7 MHz. The impedance of the system at that anti-resonance frequency is equal to 19000Ω.

Comparatively, for a system 4 according to the invention in which the filiform element 8*a* assumes the form of a semicircle measuring 2 m in diameter and the filiform element 8*b* assumes the form of a semicircle with a diameter of 4 m, it has been simulated that the impedance of the system at 3 MHz is equal to 0.004+40 j Ω. Due to the presence of the two elements 8*a*, 8*b*, the anti-resonance frequency of the system 4 is equal to 17.8 MHz. The impedance value of the system 4 according to the invention at that frequency and obtained by simulation is equal to 2400Ω.

One can see that in a system 4 according to the invention, the radiation resistance—which corresponds to the real part of the impedance—of the system 4 at low frequencies has increased considerably, and more specifically has substantially doubled.

Furthermore, the impedance of the system 4 at its anti-resonance frequency has decreased by ratio close to 10.

Alternatively, the vehicle 2 is a ship, the metal surface 6 for example corresponding to the deck of the ship.

In this alternative, it is preferable to make the filiform elements such that their mechanical strength is greater than that of the elements of a system adapted for a land vehicle.

Consequently, in the context of this alternative, the filiform elements 8*a*, 8*b* are made up of a tube or several tubes successively fastened to each other, for example by welding. The tubes are for example made from aluminum.

Figure 3:
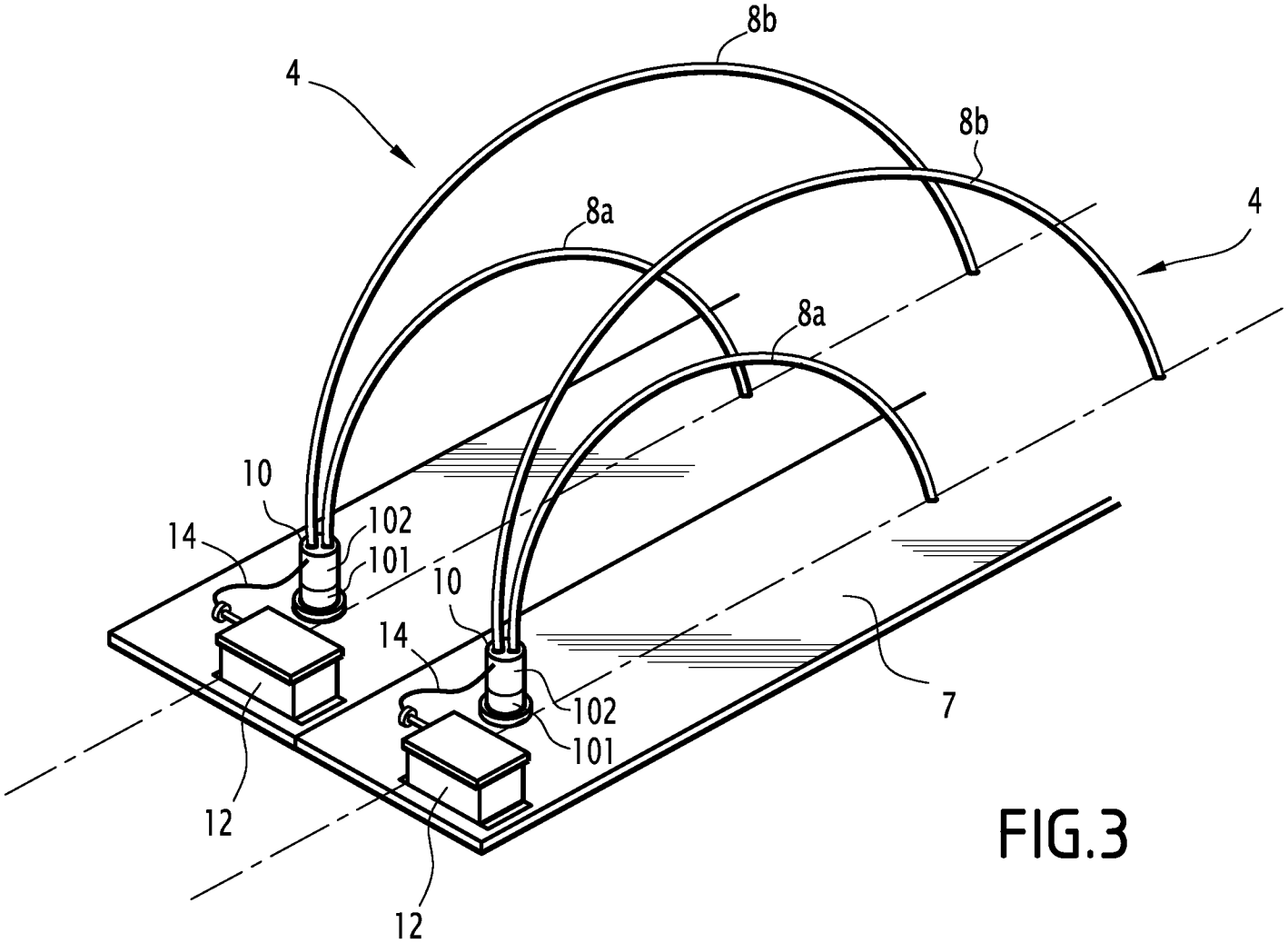
FIG. 3 is a diagrammatic illustration of the vehicle according to one alternative of the invention.

Alternatively, in reference to FIG. 3, the vehicle 2 includes two systems 4 according to the invention that are substantially identical to each other and positioned side by side substantially parallel to each other.

More specifically, they are arranged relative to one another such that the respective planes $P_a$ of the two systems 4 are parallel to each other, the respective filiform elements 8*a*, 8*b* of the two systems being located at a distance from each other of between 50 and 100 cm. This distance results in preventing the filiform elements 8*a*, 8*b* of the two systems 4 from coming into contact when they deform under the effect of the acceleration or deceleration of the vehicle 2.

The metal surface 6 of the vehicle 2 forms the ground plane 7 shared by the two systems 4.

The ATUs 12 of the two systems 4 are both connected to a same transceiver device associated with the systems 4, for example via a power divider, and are for example controlled according to the command described in FR 2,829,622.

This alternative of the vehicle 2 according to the invention results in increasing the allowable power of the device formed by the two systems 4 positioned in parallel, as well as increasing the corresponding radiation resistance at low frequencies of the usage range.

Figure 4:
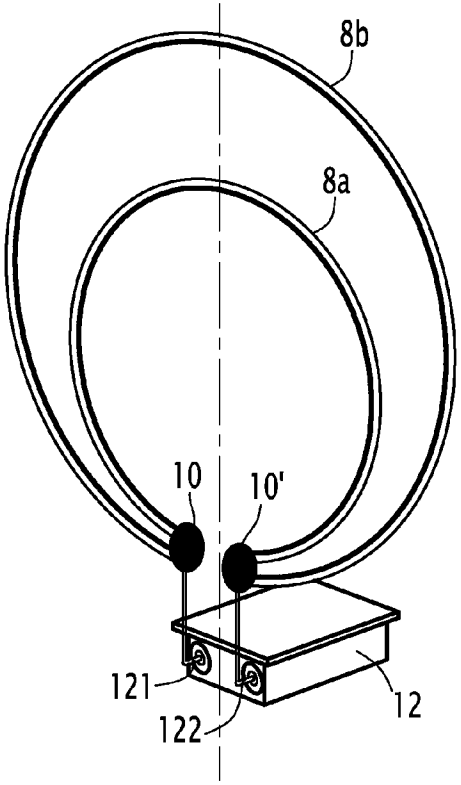
FIG. 4 is a diagrammatic illustration of an antenna system according to one alternative of the invention.

Also alternatively, in reference to FIG. 4, the system 4 does not include a ground plane 7.

In the context of this alternative, the base 10 is made up solely of the second electrically conductive part 102 previously described.

Furthermore, the system 4 includes a secondary base 10' identical to the base 10.

The two bases 10, 10' are respectively connected to one of two symmetrical channels 121, 122 included by the ATU 12 and are fastened overhanging the ATU 12, for example using electrically conductive rigid connecting rods positioned parallel to each other, and which perform the same function as the connecting cable 14 previously described as well as physically maintaining the assembly.

The connecting rods as well as the connection to the channels 121 and 122 of the ATU and the bases 10, 10' are known by those skilled in the art and therefore will not be described.

One of the ends of each filiform element 8*a*, 8*b* is inserted into the base 10, and the other end is inserted into the secondary base 10'.

The loop portions formed by the filiform elements 8*a*, 8*b* both have a substantially circular shape.

The radiation surfaces S1, S2 are only generated by the filiform elements 8*a*, 8*b*.

This alternative is advantageously implemented when the use of a ground plane is impossible or undesirable.

In another embodiment of this alternative according to the invention, the loop portions both have a generally triangular or rectangular shape.

As before, the two loop portions defined by the filiform elements 8*a*, 8*b* are interlocked in one another, respectively substantially contained in a plane, the two planes thus defined forming an angle smaller than 45°, and preferably smaller than 10°.

This alternative of the invention may in turn be implemented on a vehicle 2 according to the invention, in which the two systems according to this alternative of the invention are positioned next to one another, the two planes $P_a$ of the filiform elements 8*a*, 8*b* of both of the systems being substantially parallel and located separated from each other by a distance of between 50 cm and 100 cm.

Also alternatively, the vehicle 2 is an aircraft.

Alternatively, the system 4 has no ATU 12. The filiform elements 8*a*, 8*b* are for example directly connected to the radiofrequency transceiver device to which the device 4 is coupled. In the corresponding embodiments, the two filiform elements 8*a*, 8*b* are also supplied with the same radiofrequency signal.

As indicated above, the coupling of the filiform element 8*a*, 8*b* which results among others from the supplying of the filiform elements 8*a*, 8*b* with the same radiofrequency signal lowers the impedance of the system 4 at its anti-resonance frequency.

In addition, as indicated above, the system 4 is configured for the emission and reception of electromagnetic waves by ionospheric reflections. The filiform elements 8*a*, 8*b* are configured to radiate mostly along a vertical radiation direction.

In particular, in the embodiments in which the system 4 is located on a ground plane 7, the antenna 4 is configured to radiate orthogonally relative to the ground plane. The ground plane 7 is then laid out roughly horizontally.

In the embodiments in which in the antenna 4 is not located on a ground plane, the system 4 is configured to radiate mostly along a median axis for the loops formed by the elements 8*a*, 8*b*, the median axis stretching between the bases 10 and 10'.

The radiation direction of the antenna is a result of the ratio between the wavelengths of the frequencies preferably used by the system 4 and the length of the filiform elements 8*a*, 8*b*. More specifically, the lengths of the filiform elements 8*a*, 8*b* are of an order of magnitude smaller than the wavelengths of the preferred frequencies of the system 4. For instance, a 2 MHz frequency corresponds to a 150 m wavelength, and a 12 MHz frequency corresponds to a 25 m wavelength. These lengths present an order of magnitude greater than the length of the filiform elements 8*a*, 8*b*.

The invention claimed is:

1. A loop antenna system comprising:

a first electrically conductive filiform element forming a loop portion; and a second electrically conductive filiform element forming a loop portion, wherein the first and second filiform elements have different lengths, and wherein one end of each of the first and second electrically conductive filiform elements is configured to receive the same radiofrequency signal, wherein the anti-resonance frequency of the loop antenna system is configured to be different from the anti-resonant frequency of each of the first and second electrically conductive filiform elements.

2. The antenna system according to claim 1, wherein the length of the longest filiform element is more than 50% longer than the length of the shortest filiform element.

3. The antenna system according to claim 1, wherein the length of the longest filiform element is substantially equal to twice the length of the shortest filiform element.

4. The antenna system according to claim 1, wherein the first filiform element is substantially comprised in a first plane, wherein the second filiform element is substantially comprised in a second plane, and wherein the first and second planes together form an angle that is smaller than 45°.

5. The antenna system according to claim 1, wherein the loop portions formed by the filiform elements are interlocked in one another.

6. The antenna system according to claim 1, further comprising a fastening base for fastening filiform elements, the fastening base including a second electrically conductive part in which each of the ends of the filiform elements that are configured to receive the radiofrequency signal is fastened.

7. The antenna system according to claim 6, further comprising an antenna tuning unit electrically connected to the second part to supply the two filiform elements with a same radiofrequency signal.

8. The system according to claim 7, further comprising a secondary fastening base in which the other ends of the filiform elements are fastened, the antenna tuning unit having two symmetrical channels whereof one of the symmetrical channels is connected to the fastening base and the other is connected to the secondary fastening base.

9. The antenna system according to claim 6, further comprising a ground plane, said fastening base including a first electrically insulating part fastened on said first plane and on which the second part is fastened, the other ends of the filiform elements being fastened to the ground plane.

10. The antenna system according to claim 1, wherein the first and second electrically conductive filiform elements are configured for the transmission and reception of electromagnetic waves with a frequency comprised between 2 MHz and 30 MHz.

11. The antenna system according to claim 4, wherein the angle between the first and second planes is smaller than 10°.

12. The antenna system of claim 1, further comprising a ground plane to which the other ends of the first and second electrically conductive filiform elements are fastened.

13. The antenna system of claim 12, wherein the ends of the first and second electrically conductive filiform elements that are configured to receive the radiofrequency signal are electrically insulated from the ground plane.

14. A loop antenna system, comprising:

a first electrically conductive filiform element forming a loop portion;

a second electrically conductive filiform element forming a loop portion; and a ground plane, wherein the first and second filiform elements have different lengths, wherein one end of each of the first and second electrically conductive filiform elements is configured to receive the same radiofrequency signal, wherein the ground plane is substantially orthogonal to a plane defined by at least one of the first and second filiform elements, and wherein the anti-resonance frequency of the loop antenna system is configured to be different from the anti-resonant frequency of each of the first and second electrically conductive filiform elements.

15. A loop antenna system, comprising:

a first electrically conductive filiform element forming a loop portion; and a second electrically conductive filiform element forming a loop portion, wherein the first and second filiform elements have different lengths, wherein one end of each of the first and second electrically conductive filiform elements is configured to receive the same radiofrequency signal, wherein the first and second filiform elements are not formed on a substrate, and wherein the anti-resonance frequency of the loop antenna system is configured to be different from the anti-resonant frequency of each of the first and second electrically conductive filiform elements.

16. A land, air or sea vehicle, comprising:

at least one loop antenna system, the at least one loop antenna comprising:

a first electrically conductive filiform element forming a loop portion; and a second electrically conductive filiform element forming a loop portion, wherein the first and second filiform elements have different lengths, wherein one end of each of the first and second electrically conductive filiform elements is configured to receive the same radiofrequency signal, and wherein the anti-resonance frequency of the loop antenna system is configured to be different from the anti-resonant frequency of each of the first and second electrically conductive filiform elements.

17. The vehicle according to claim 16, further comprising two antenna systems, the antenna systems being identical to each other and being positioned side by side and parallel to each other.

* * * * *